United States Patent [19]

Joseph

[11] 4,221,662

[45] Sep. 9, 1980

[54] POOL SKIMMING DEVICE

[76] Inventor: John Joseph, 2827 Echo Way, Sacramento, Calif. 95825

[21] Appl. No.: 953,897

[22] Filed: Oct. 23, 1978

[51] Int. Cl.[2] ..... E04H 3/20

[52] U.S. Cl. ..... 210/169; 210/242 R

[58] Field of Search ..... 210/169, 242, 542, 538

[56] References Cited

U.S. PATENT DOCUMENTS

| | | | |
|---|---|---|---|
| 3,152,076 | 10/1964 | Krutzer | 210/242 R |
| 3,217,886 | 11/1965 | Ruston | 210/242 R |
| 3,244,284 | 4/1966 | Shaffer | 210/242 R |
| 3,774,767 | 11/1973 | Field | 210/242 R |

*Primary Examiner*—Theodore A. Granger

*Attorney, Agent, or Firm*—Mark C. Jacobs

[57] ABSTRACT

A skimmer aid device that is detachably secured to the skimmer inlet of a swimming pool. The device directs surface debris to the skimmer for removal from the swimming pool and the ultimate collection of said debris.

5 Claims, 16 Drawing Figures

POOL SKIMMING DEVICE

BACKGROUND OF THE INVENTION

When a family decides to buy a swimming pool, they must originally decide between an in ground or above ground type pool. The advantages of an above ground pool include substantially lower costs and the ability to construct same on smaller plots of ground. In addition, above ground pools can be taken down for storage at the end of the user's season, or moved to another location should the purchaser buy another home. All swimming pools, above and below ground alike, require filtration systems and periodic maintenance. This maintenance includes the necessity to remove surface dirt and debris, and to remove suspended particles such as dust, pollen and other particulates from the water.

The filtration systems normally employed with swimming pools include a pump, suitable piping and a skimmer outlet or trough. The skimmer trough is located within the pool, usually at the top of the water surface at the end of the pool in which the prevailing winds will blow the debris and dust in said pool. The skimmer outlet is piped to be in fluid communication to a filtration system which includes the above mentioned pump and a diatonaceous earth or other filter media which is known to the art and which forms no part of this invention. From the filter medium the water, having been cleansed, is piped back into the swimming pool.

While current filtration systems for above ground swimming pools are indeed operable, they are costly insofar as the amount of energy required to operate same due to low efficiency By low efficiency it is meant that it will take approximately ten hours of filtration during the peak pool season, namely June, July and August of most locations, in order to filter the average above ground swimming pool. One of the reasons attributed by applicant to the excessive time required to cleanse such pools is the fact that there is currently not available in the marketplace any means to aid in the operation of the filtration system by directing the surface dirt, dust and particulate matter to the skimmer outlet. It was due to applicant's desire to conserve energy in these progressive times that led him to devise the device of this invention.

Accordingly it is one object of this invention to disclose a novel skimming device to be used primarily with above ground swimming pools.

Another object of this invention is to disclose a skimming device that is low in cost and which is easy to operate.

Still another object is to prepare a device which can be used to aid in the removal of dirt and debris from above ground, primarily, swimming pools.

Another object is the disposition of a product which is substantially inert and which will have no effect on the swimming pool water.

A further object of this invention is to disclose a device which can be set in place by a child and which is easy to operate in view of the fact that it has no moving parts.

Yet another further object is to disclose a skimmer device which can be left in place in the swimming pool at all times if such is desired by the owner and which will not interfer with swimmers in a hazardous fashion.

Other objects will in part be obvious and will in part appear hereinafter.

The invention accordingly comprises the product possessing the features, properties and the relation of components which are exemplified in the following detailed disclosure, and the scope of the application of which will be indicated in the claims.

For a fuller understanding of the nature and objects of the invention, reference should be had to the following detailed description and the accompanying drawings.

SUMMARY OF THE INVENTION

The device of this invention is a skimmer aid comprising in general a body portion connected to a stabilizer section with securing means at opposite ends of said device, said securing means preferably being attached to the stabilizer section to detachably maintain the skimmer in a relatively fixed location. At least one end's securing means comprises a suspended weight which acts as an anchor.

DESCRIPTION OF THE PREFERRED EMBODIMENT

Figure 4:
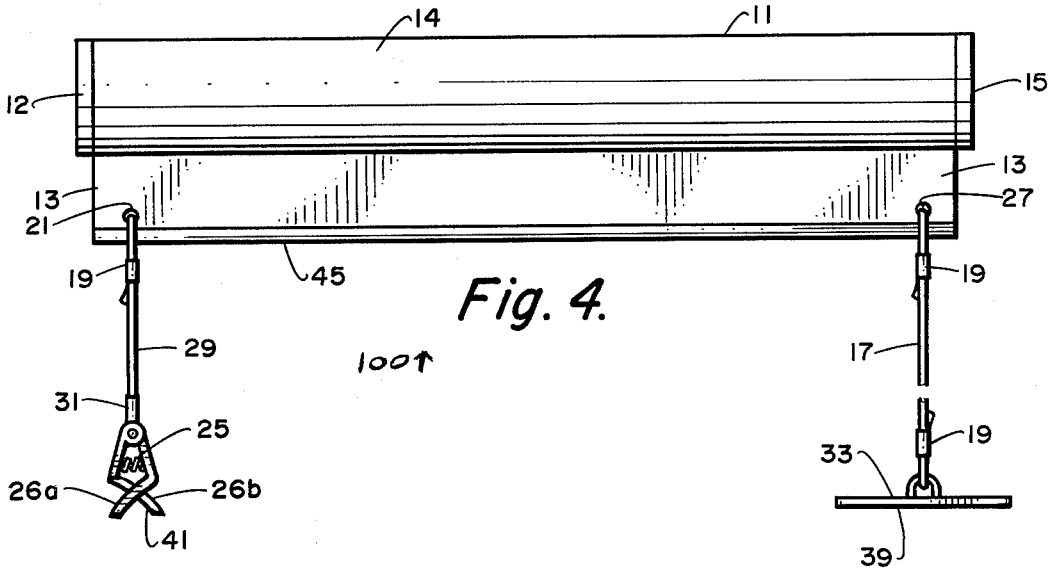
FIG. 4 is a front elevational view of the embodiment of this invention shown in FIG. 2.

Per FIG. 4, the skimmer aid 100 of this invention comprises a body 11 connected to a stabilizer 13. Body 11 comprises a main section 14 sealed on both ends by an end cap 12 and 15. Main section 14 is preferably hollow and may be made of such materials as PVC, polycarbonate ABS or any other polymeric material that is not degradable by the chlorine or other chemicals in the pool water, and which is not subject to acute UV light degradation. It has been found that Schedule 40 PVC suffices quite well for main section 14, since stabilizer 13 is formable or attachable thereon.

End caps 12 and 15 include an inward extending boss 43 around the periphery thereof and an upward portion 44. The cross section of 43 is sized slightly smaller than the ID of tubular main section 14. End caps 12 and 15 are secured to main section 14 by adhesing boss 43 to the thickness of the main section 14 around the periphery thereof. Thus it is seen that preferably the set off of boss 44 should be substantially equal to or slightly larger than the thickness of the tubular main section 14 in order to house insert section 43 about the interior of main section 14 upon the insertion of caps 12 and 15 into main section 14. Any adhesive known to the art and suitable for a waterproof connection may be used to join the end caps to the main section 14. End caps 12 and 15 must be made of compatible plastic to that used for main section 14. Usually one would choose to use the same plastic for parts 14, 13, 12 and 15 to ensure ease of fabrication.

Body 11 is generally from about 36" inches to about 72" inches long. It has been found that the cross section of 14 can vary from about $\frac{7}{8}$" to $1\frac{1}{2}$" and still give adequate performance without high cost and heavy weight. Obviously larger diameters can be employed as well as length, if desired.

Stabilizer 13 is sized preferably to be of substantial the same length as body 11. Stabilizer 13 is adhesed on the top surface thereof 45 to the underside of tubular main section 14. Stabilizer 13 should be adhesed or otherwise secured perpendicular to the tangent of main body 14 at least from the rear forwardly.

Mention may be made of the fact that main section 14 and stabilizer 13 may be manufactured as but one extrusion if desired in order to achieve lower cost of manufacturing.

The stabilizer 13 is usually of about 0.0020" to about 0.0030" thickness and again may be made of any rigid plastic capable of being adhesed to or otherwise secured to main section 14.

As in sailing, the height of the stabilizer will vary with the size and weight of the item, here body 11, being balanced for stability. Thus, with a $1\frac{1}{2}$" diameter body 14, I found that an elevation of $\frac{7}{8}$" performed satisfactorily. It is within the skill of the art to alter the dimension of the elevation to maintain the stability of the body section 11 within the pool.

Spaced apart on opposite ends of stabilizer 13 are apertures 27 and 21 usually of about $\frac{1}{4}$ inch or less in diameter. The exact position vertically is not important, but for good practice a location about the midpoint of the elevation is preferred. Through each of these is inserted a cord 17 and 29 respectively. These are looped through the aperture, and the end thereof is secured along the length thereof by ferrults 19. The length of forward cord 17, sized to touch the pool bottom, usually $3\frac{1}{2}$' to $4\frac{1}{2}$' is secured to a coated 39, weight 33, through the aperture in the weight. Optional coating 39 may be epoxy or another waterproof paint. The actual securing may be by ferrule or knot. Short cord 29, usually 4 to 8 inches long is secured to spring 25 actuated clip 23 having two jaws 26A and 26B, by knot or ferrule. Coating 41 is optional to prevent attack by chlorine or salt and is epoxy or acrylic.

Figure 2:
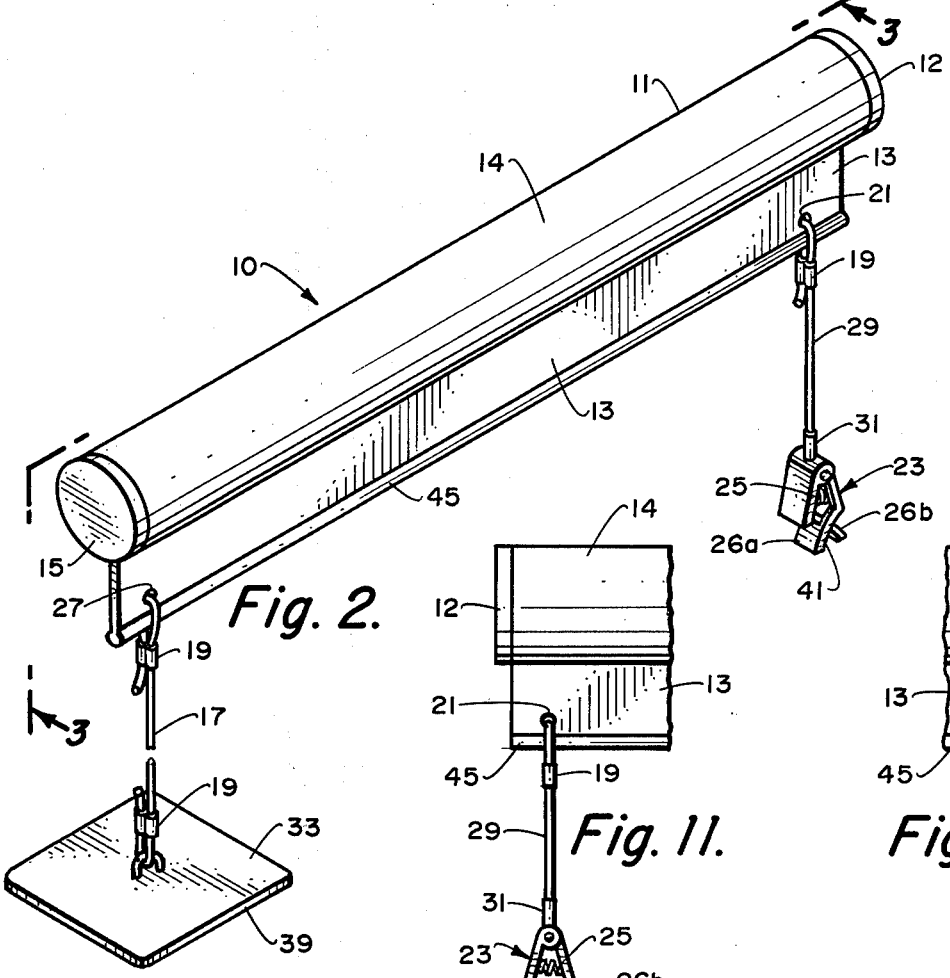
FIG. 2 is a perspective view of the body portion of one embodiment of this invention.

It is seen that FIG. 2 is a perspective view of the body 11, which comprises main section 14 to which is secured stabilizer or keel 13. The section lines 3—3 show where the cross-sectional view of FIG. 3 is taken.

Figure 3:
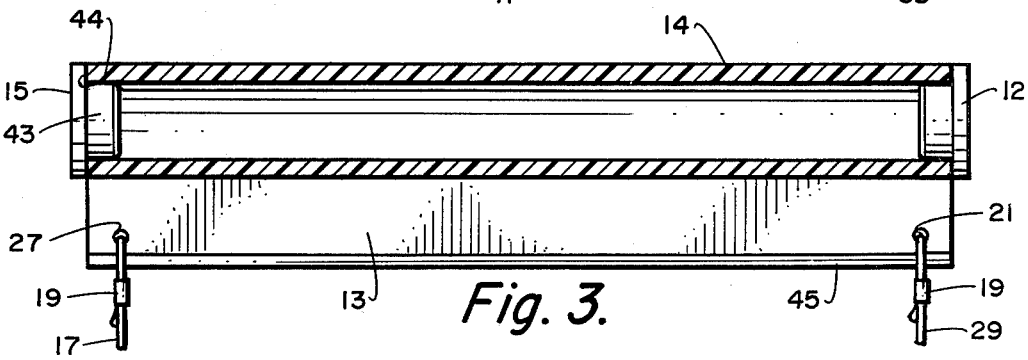
FIG. 3 is a cross sectional view along the line 3—3 of FIG. 2.

In FIG. 3 main section 14 is seen to be tubular with end caps adhesed or otherwise secured thereto. End caps 12 and 15 are of a diameter equal to the OD of tubular section 14. The elevation of notch 44 corresponds to the thickness of tube 14. The elevation of the boss 43 corresponds to the ID of 14. While a friction fit might suffice, an adhesed fitting is preferred to prevent water from entering 14.

Figure 5:
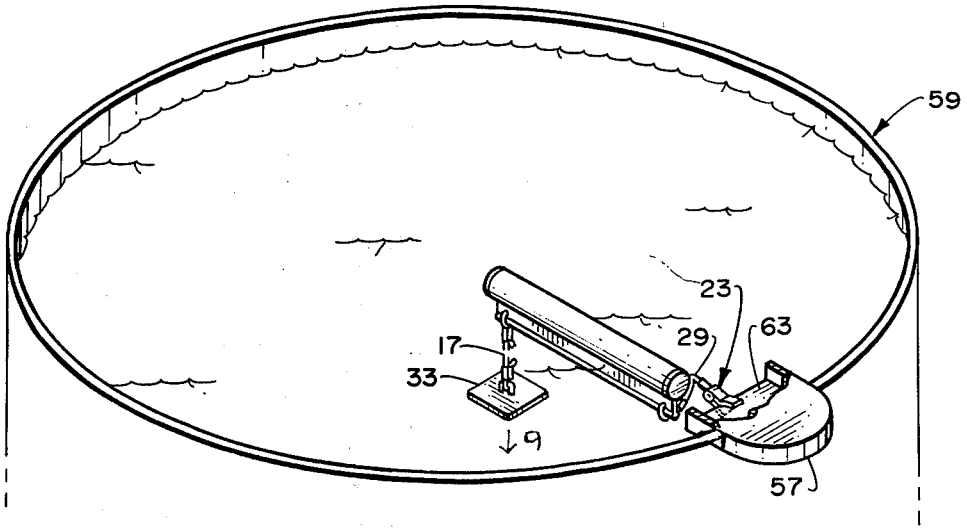
FIG. 5 is a top perspective view showing a device according to this invention in operating position in an above-ground swimming pool.

In FIG. 5 the embodiment of FIG. 4 is shown disposed for operation in a pool 59. A portion of skimmer 57, which protrudes out from this above ground pool is shown cutaway, such that skimmer inlet 63's lower horizontal surface can be seen. Clip 23 is seen attached at the end of cord 29 which is depending from the keel 13. The water return from the filter system is not seen in this figure.

Figure 1:
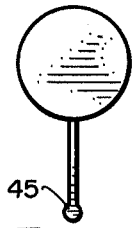
FIG. 1 is an end view of the embodiment of FIG. 2.
Figure 6:
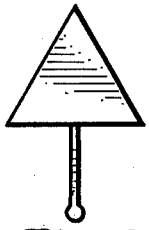
FIGS. 6–10 are end views of alternate embodiments of the body portion of this invention.
Figure 7:
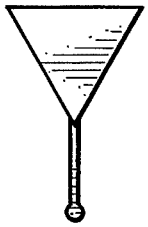
Figure 8:
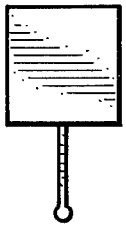
Figure 9:
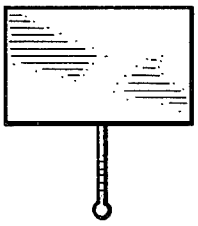
Figure 10:
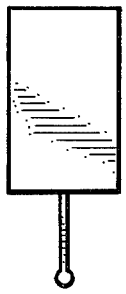

FIGS. 6,7,8,9, and 10 depict various shapes that main section 14 can assume, other than circular which is disclosed in FIG. 1. Each of these shapes and others contemplated but not disclosed herein within the skill of the art may be employed for the purposes desired herein to achieve similar results. The small bead 45, as seen in FIGS. 1 and 6 to 10 is optional, and does not add or detract from the operation of the device. Such bead is discussed infra.

Figure 11:
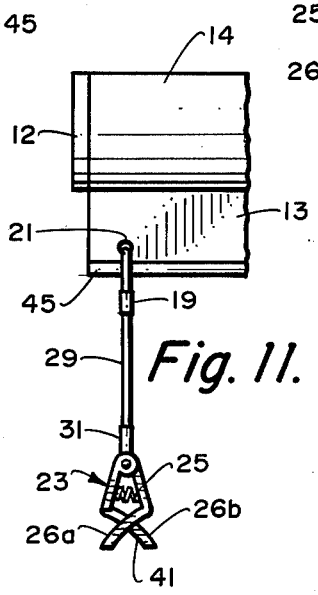
FIG. 11 is a closeup elevational view of the securing means associated with this invention.
Figure 12:
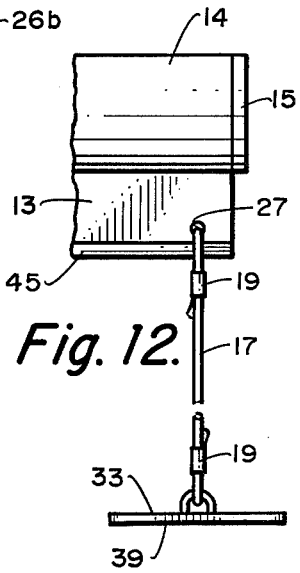
FIG. 12 is a closeup elevational view of the anchoring means associated with this invention.

FIGS. 11 and 12 are fragmented closeup views of parts of the embodiment of FIG. 4. If the shape of section 14 is altered herein, these figures can also depict portions of the versions seen in FIGS. 6 through 10.

Figure 16:
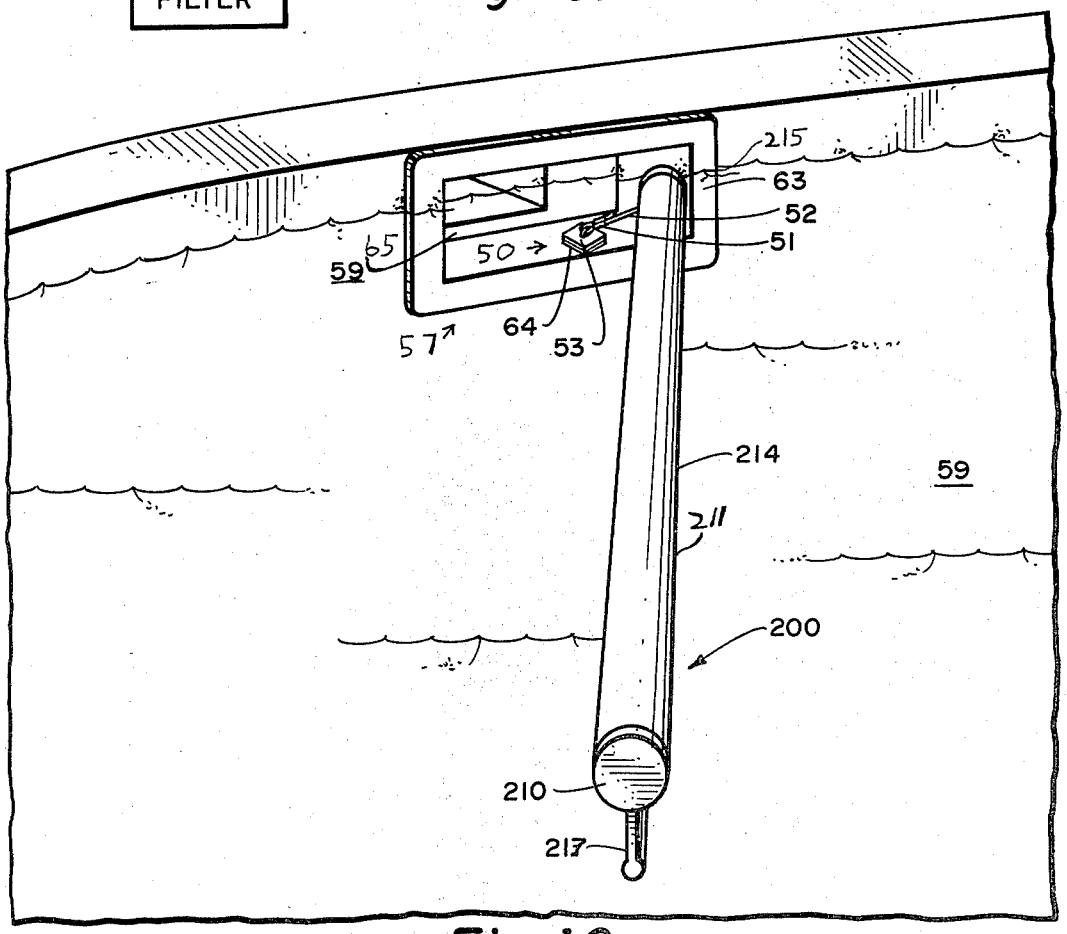
FIG. 16 is a perspective view showing the deployment of embodiment of this invention.

In FIG. 16 there is shown an alternate embodiment of this invention 200 which lends itself primarily to be used with below ground pools. Body 211, comprised of main section 214 and stabilizer 213 and the end caps 215 and 210 is the same as previously discussed with respect to embodiment 100. In this embodiment spring clip 23 is omitted and replaced by short weight 50 comprised of cord 52 secured by a ferrule 51 to a weight 53. Cord 52 is sized such that when extended from the device 200 there is little or no slack, thereby retaining the device in position abutting skimmer 57 of pool 59. Skimmer 57 comprises a generally rectangular inlet portion 63 within the pool and usually tile lined which is in fluid communication with main water receiving section 65, disposed outside of the pool confines. Adhered, preferably to the lower horizontal section of the skimmer inlet 63 by a suitable adhesive is a strip of either male or female Velcro ®, 64. Velcro ® is a closure, known to the art, comprised of a multitude of short filaments of synthetic plastic such as nylon which are adapted to mesh with and interlock against a 2nd material made also of a multitude of short wire-like filaments which are shaped to become hooked with the filaments of the first material aforementioned. Such materials are presently available under the commercial name of Velcro ® manufactured by the Velcro Corporation, New York, N.Y.

Secured by a suitable adhesive to the underside of weight 53 is the opposite portion of the Velcro ® fastener from that attached to inlet 63. Thus by meshing the Velcro ®, embodiment 200 can be removably secured to said inlet 63.

Optionally, weight 53 may be coated with a non-toxic coating such as an epoxy paint. The securing means e.g. weight 33 is not seen in this Figure. Also note that in FIGS. 2, 4 and 12 cord 17 is fragmented to scalewise depict actual length. In FIG. 5 cord 17 is also fragmented and arrow 9 is to indicate that weight 33 is to be disposed to the bottom of pool 59.

Figure 13:
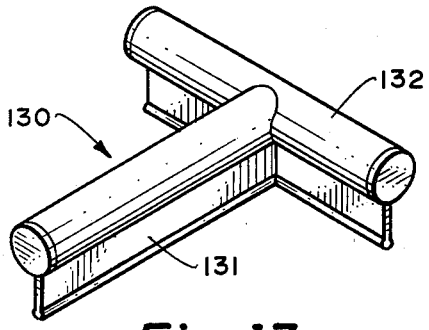
FIG. 13 is a perspective view of another embodiment of this invention.
Figure 14:
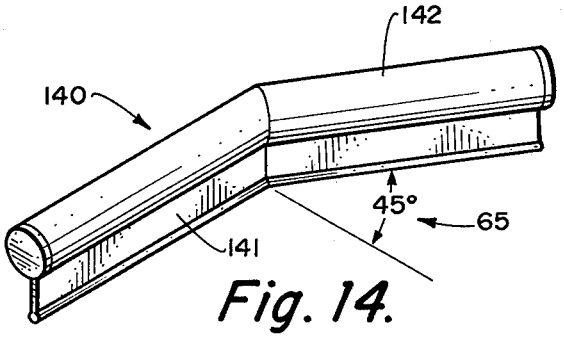
FIG. 14 is a perspective view of still another embodiment of this invention.

In FIGS. 13 and 14 there are depicted embodiments of the invention particularly suited for use in above ground pools which have the filtered water return in close approximation to the skimmer box 57. Good diversion occurs when angle 65 is 45° or more.

In the previous configurations discussed, the stabilizer 13 acts to reduce the water current that the particles of debris, leaves, etc. on the water surface have a larger dwell time in the vicinity of the skimmer box such that the suction of the skimmer box has adequate time to act upon said debris. In addition, the stabilizer aids the body 11 in guiding the debris to the skimmer inlet 63. Some debris, however, can and does get around the furthest edge of the device 10 and escapes back into the main stream of the pool.

It is this escaping debris that the embodiments of FIGS. 13 and 14 are particularly adapted to deal with. It should be understood that other embodiments having a second body and stabilizer portion designated an extreme section of differing configurations secured to and angled off slowly from the main section of the device may be employed.

Figure 15:
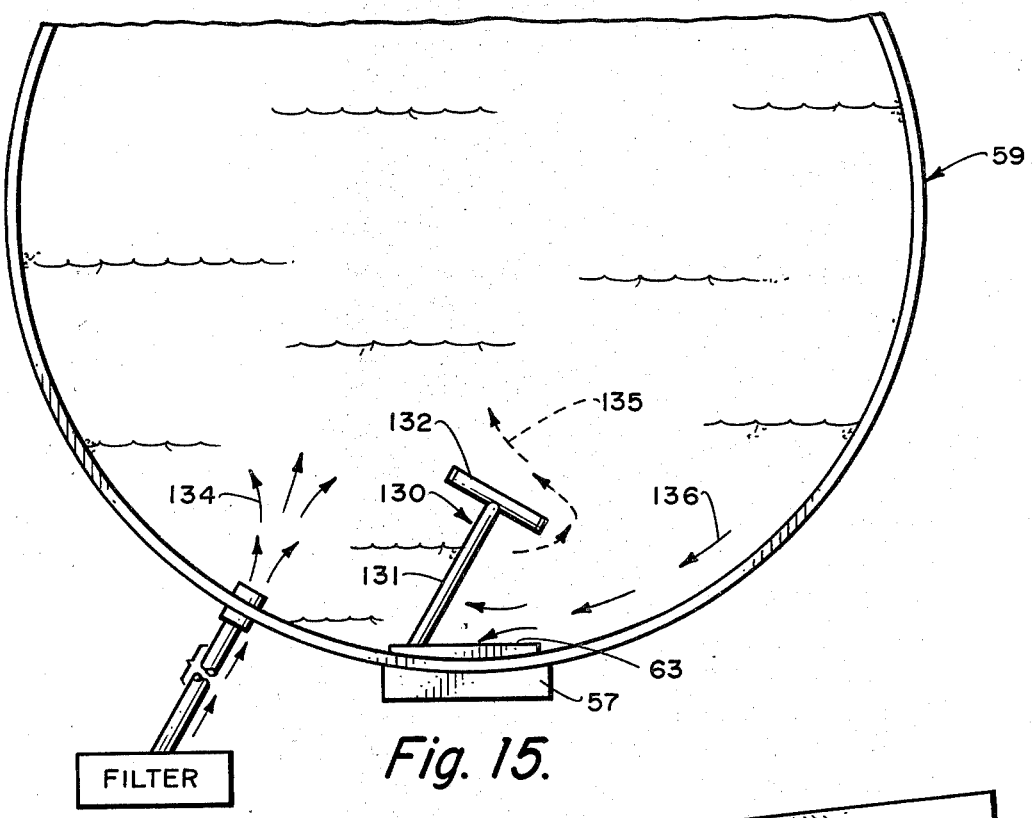
FIG. 15 is a top plan view of an above ground pool with the device of FIG. 13 therein.

The extreme section designated 132 for the embodiment of FIG. 13 and 142 for the embodiment of FIG. 14 tend to force the escaping debris outwardly and away from the return water line. [note the path of travel as shown by the dotted line 135 in FIG. 15] This diverting action tends to prevent the return of the debris down the left side of the main section 132 of the device, per FIG. 15. The reason this is desired is to prevent the return line water from impinging upon the surface debris, causing it to tumble and sink to the bottom of the pool, or become suspended below the water's surface. Dirt below the surface is not readily removable by the action of the skimmer box.

I have found that an extreme section varying in length from about 1 to 2 feet is beneficial.

In all aspects of construction, the embodiments shown in FIGS. 13 and 14 are similar to those previously discussed. Further, it is within the skill of the art of the plastics technician to form the invention in the configuration shown in FIGS. 13 and 14. This is evidenced by the existence of Tee-shaped and 45° angle connectors for P.V.C. pipe. Junctions of flat stock used for the stabilizer are easy to form.

An optional bead may be attached along the length of keel 13 at the distal end thereof for ease of manufacture. See FIG. 1 where such bead is designated 45. Such bead is also found in the embodiments of FIGS. 6 through 10, but is completely optional.

In FIG. 15, device 130 of FIG. 13 is shown disposed in 59, an above ground pool. While a forward securing weight is required, such is not seen in this figure, as the weight would be directly below or slightly out from the body of the device at the end of its long cord. Device 130 is seen to be secured to skimmer inlet 63. Debris represented by arrows 136 flow toward skimmer 57. If device 130 were not present, the skimmer's suction would draw in debris within 4 to 8 inches from the inlet, 63. But with the devices of this invention surface debris along almost the entire length of the device are urged toward the skimmer. Dotted line 135 represents debris not affected by the suction of the skimmer 57 and which therefore escapes out into the centre of the pool. Extreme section 132 acts to keep debris 135 on the water surface, by preventing it from moving down the opposite side of 131 where it will impinge upon water 134 exiting from the water return line of the filter.

In below ground pools the embodiments of FIGS. 13 and 14 though operable are not necessary. In below ground pools, the return water is located distant from the skimmers.

While all embodiments have been shown to be tubular of one configuration or another, it is within the skill of the art to also employ solid main sections 14. It is also recognized that if tubular versions are employed that these can be filled as with styrene or urethane foams to keep out water.

The stabilizer or keel has been shown to extend along the entire length of the main section. Though not critical, it is beneficial to do so. In any event, the keel should extend to the rear of the main section. ie. that end detachably secured to the skimmer inlet.

The length of the forward cord has been previously indicated to usually be $3\frac{1}{2}$ to $4\frac{1}{2}$ feet, as this is the average depth of an above ground pool. For below ground pools this cord will usually be six to eight feet or longer, depending on the pool depth.

While the bead 45 has been indicated to be optional, its presence is more than cosmetic. It has been found that this bead to a slight degree prevents debris, such as leaf stems, from getting under the keel, thereby avoiding delivery of said debris to the skimmer box.

Operation

In order to utilize the device of this invention, the skimmer 100 is placed in the water with keel 13 projecting downwardly into the water. Spring clip 23 is secured to skimmer inlet 63, while anchor line 17, having anchor weight 33 thereupon, is let out such that weight 33 can be disposed generally downwardly toward the bottom of the pool. This should be done slowly in order to prevent injury to the vinyl liner normally found in most above ground swimming pools. Anchor weight 33 resting on the bottom of the pool, in conjunction with spring clip 23, serves to secure skimmer 100 into location relative to the skimmer outlet. The anchor weight is such that if another locaion is desired within the pool, the skimmer may be readily relocated merely by pulling or tugging on the anchor line to relocate the anchor weight at the bottom of the pool. It has been found that a suitable angle for the disposition of the skimmer of this invention has measured between about 45° to 90°. The actual angle to be employed is not critical and will vary with the prevailing wind of the area in which the swimming pool is located.

It has been found that by employing the device of this invention to aid in the direction of the particulate matter to the skimmer outlet, that effective pool filtering capability is about 9 to 15 times. That is, a swimming pool which formerly required eight hours of filtration can now be completely filtered to remove particulates, etc. in two hours.

Thus when a skimmer aid prepared in accordance with this invention was inserted in a Muskin® swimming pool of 15K gallons in Sacramento, Calif. where the prevailing winds are from the southwest, such that the device was aimed in a noretheasterly direction from the skimmer outlet, it was found said pool which formerly required 8 hours for filtration and cleaning could now be completed within about two hours.

While body section 11 and rudder 13 have been disclosed as separate parts, it is within the scope of this invention to extrude same together as one member. If such practice is carried out, it will still be necessary to adhese end caps 15 and 12 on the opposite ends of said extrusion in order to provide proper buoyancy to the device by maintaining water out of 14. See FIG. 3. Cap 15 at the forward and cap 12 at the rearward ends of main section 14.

While I have disclosed only a few of the multitude of shapes that may be employed for the body section of this invention, it is obvious that other shapes may be employed for said body section. Rutter sections that project into the water may be necessary when other shapes are employed. It is within the skill of the art to determine the relative depth of the rutter with respect to the body portion being employed in order to maintain the proper balance within the water of said body section.

While spring clips have been shown, it is also within the skill of the art to use other securing means to attach the device of this invention to the skimmer outlet.

While anchor weight shown in the drawings is generally flat, this configuration was chosen in order to prevent or to at least limit the possibility of persons walking in the pool water from tripping or stubbing their toes on the weight line at the bottom of the pool. It is seen therefore that there is however no criticallity in the choice of shape of said weight. This like any other anchor acts to restrict the movement of the forward end, while allowing some movement as determined by the amount of slack in line 17.

In retrospect it is seen that I have disclosed a device which is low in cost which can be readily employed by persons of all ages and which will aid in the removal of foreign matter from swimming pool water. The invention of this application is easy to manufacture and thus can be sold at a reasonable price. The big advantage to the home owner is the fact that in six months time the device of this application will pay for itself due to the savings in energy for the operation of the filtration pump. In addition, pump life is extended and vacuuming of the pool is made a less frequent chore.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A swimming pool skimming aid for directing surface debris to the skimmer inlet of a swimming pool, comprising a body having an elongated tubular main section closed on both ends, and a stabilizer keel extending along the length of said main section on the underside thereof, from the forward end to the rearward end of said body, said tubular main section and stabilizer being one piece, said stabilizer having a bead extending the length of the stabilizer along the edge thereof not attached to the main section.

means to restrict the movement of the forward end of said body comprising a weight on a line attached to the forward end of said body on the stabilizer, and means to detachably secure the rearward end of said body to a pool skimmer inlet, said means being attached at the rearward end of said body.

2. The skimmer aide of claim 1 wherein the means to detachably secure the rearward end of said body to a pool skimmer inlet is attached on the keel of said body.

3. In the device of claim 1 wherein at least one of said means are weight and spring clips coated to resist chemical reaction with pool water.

4. In the device of claim 1 wherein the means to detachably secure the rearward section to a pool skimmer inlet, comprises a weight attached by a short line to the rearward end of said body.

5. In the device of claim 4 said weight has a Velcro ® strip on the underside thereof adapted to engage another piece of Velcro ® on a pool skimmer inlet.

* * * * *